US005369834A

United States Patent [19]

Groen et al.

[11] Patent Number: 5,369,834

[45] Date of Patent: Dec. 6, 1994

[54] ROTARY DUCT CLEANING BRUSH DEVICE

[76] Inventors: Douglas D. Groen, 913 Cortland Dr., Apple Valley, Minn. 55124; Kenneth W. Witte, 20555 Italy Ave. W., Lakeville, Minn. 55044

[21] Appl. No.: 243,758

[22] Filed: May 17, 1994

[51] Int. Cl.[5] ..... B08B 9/02

[52] U.S. Cl. ..... 15/104.095; 15/104.09; 15/179; 15/194; 15/200

[58] Field of Search ..... 15/23, 104.09, 104.095, 15/104.096, 104.11, 104.12, 104.2, 104.31, 179, 181, 194, 198, 200

[56] References Cited

U.S. PATENT DOCUMENTS

| | | | |
|---|---|---|---|
| 271,358 | 1/1883 | Pike | 15/104.09 |
| 1,663,194 | 3/1928 | Denman | 15/200 |
| 1,671,374 | 5/1928 | Moore et al. | 15/104.12 |
| 2,161,028 | 6/1939 | Dubosclard | 15/104.095 |
| 2,626,413 | 1/1953 | Girton | 15/104.095 |
| 3,176,772 | 4/1965 | MacGregor | 15/200 |
| 3,305,888 | 2/1967 | Soderberg | 15/200 |
| 3,314,095 | 4/1967 | Prange | 15/200 |
| 4,534,080 | 8/1987 | Young et al. | 15/179 |

FOREIGN PATENT DOCUMENTS

| | | | |
|---|---|---|---|
| 390741 | 8/1908 | France | 15/104.05 |
| 237965 | 8/1925 | United Kingdom | 15/200 |
| 8002656 | 12/1980 | WIPO | 15/104.2 |

OTHER PUBLICATIONS

Whirlflex Sales, Inc. "The 100% Mechanical Pipe Cleaner", Nov. 3, 1939, pp. 1-2.

*Primary Examiner*—Mark Spisich

*Attorney, Agent, or Firm*—Herman H. Bains

[57] ABSTRACT

A rotary air-driven brush device for cleaning air ducts comprises a reversible rotary air motor connected to a source of air under pressure and having a threaded output shaft. A brush head includes an inner mounting member secured to the output shaft and an outer housing spaced from the inner mounting member. A plurality of brush members are removably mounted in axially spaced apart openings extending through the brush head mounting member. The brush members include tubular bristle holder elements which are secured in the openings in the brush head by set screws. A plurality of support legs having rollers thereon support and guide the brush head within the duct during the duct cleaning operation.

9 Claims, 2 Drawing Sheets

ROTARY DUCT CLEANING BRUSH DEVICE

FIELD OF THE INVENTION

This invention relates to cleaning devices for air ducts and more specifically to a pneumatically driven brush device for cleaning air ducts.

BACKGROUND OF THE INVENTION

Proper maintenance of air ducts used in ventilation, heating and air conditioning systems require periodic cleaning of the ducts. Some prior art devices use air streams ejected from nozzles connected to a source of air under pressure to clean the ducts. Other prior art cleaning devices use electrical or air driven brushes for cleaning air ducts. Since:air ducts vary in size, brushes of varying sizes are typically required to effectively clean the ducts. Some air ducts are lined with insulating material and care must be taken during the cleaning operation to avoid damage to the insulation. The present invention is directed to overcoming the problems associated with prior art cleaning devices.

SUMMARY OF THE INVENTION

It is an object of this invention to provide a pneumatically driven rotary brush device for cleaning air ducts which has a brush head having readily replaceable brush members to permit adaptation of the brush for cleaning ducts which vary in size and construction.

In the present invention, the rotary brush head is driven by a rotary air motor having a non-rotatable male coupling element connected to a flexible air line by a conventional female coupling member. The brush head includes an inner mounting member and an outer housing which is formed of plastic and is preferably of cylindrical configuration. The inner mounting member is readily connectible to the output shaft of the rotary air motor. The brush head has a plurality of axially spaced apart openings extending transversely through the head. These openings accommodate brush members formed of elongate tubular elements which are secured to the inner mounting member by set screws. Each tubular element has a plurality of elongate bristles therein and projecting therefrom. This arrangement of brush heads permits the brush device to be readily adapted (by changing the brush members) for cleaning air duct of varying sizes. In the preferred embodiment, a housing is positioned around and is spaced radially outwardly from the guide members. Support legs guide and hold the brush head during the cleaning operation.

FIGURES OF THE DRAWING

DESCRIPTION OF THE PREFERRED EMBODIMENT

Figures 1, 2, 3, 4, 5:
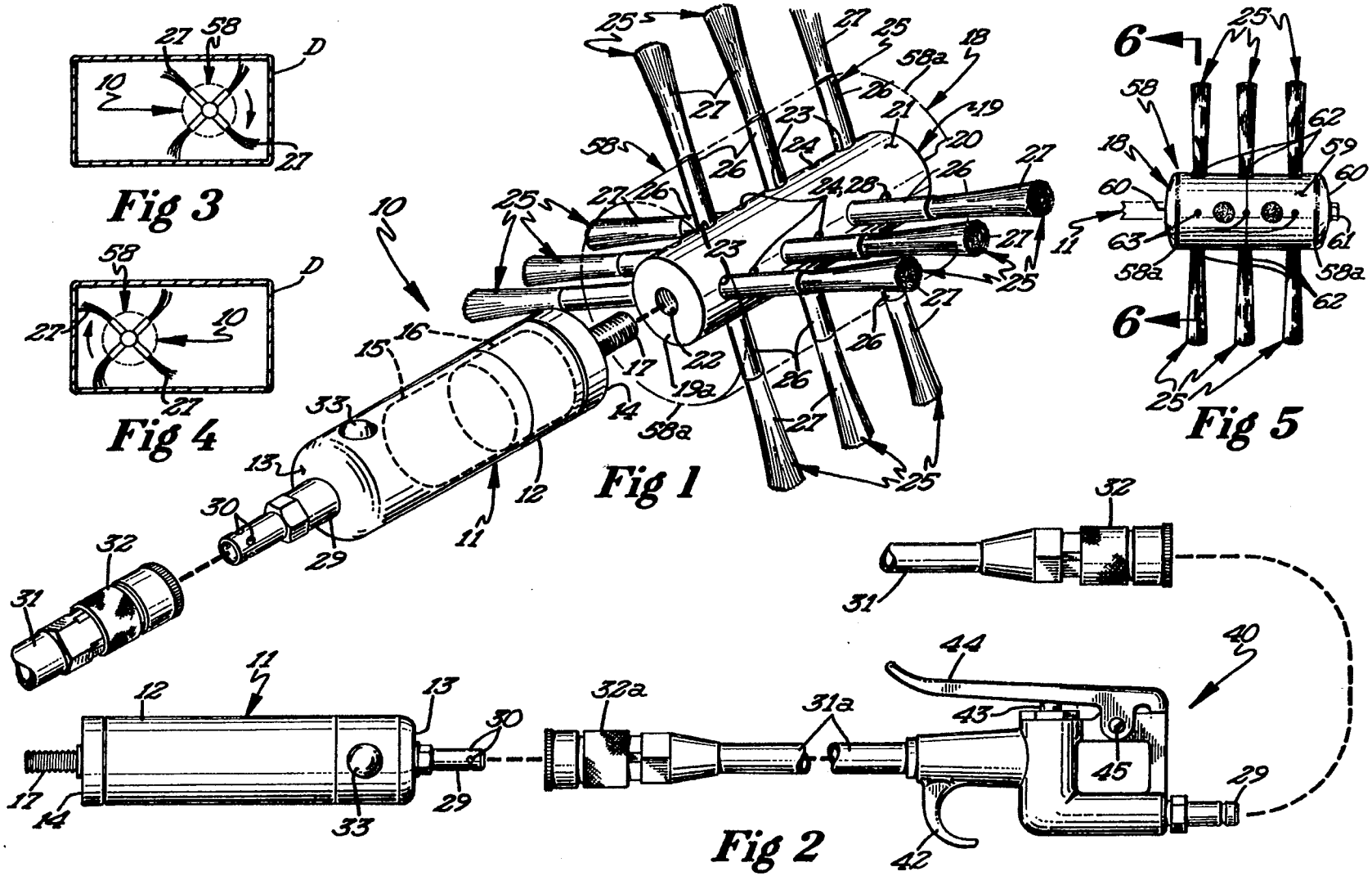
FIG. 1 is a perspective view of one embodiment of the novel duct cleaning device illustrating the inner mounting member of the brush head in full line configuration and illustrating the outer housing in phantom line configuration.
FIG. 2 is a perspective view of a modified form of the control means for the duct cleaning device.
FIG. 3 is a cross-sectional view of an air duct illustrating the manner in which the duct cleaning device is applied to and cleans one side of an air duct.
FIG. 4 is a diagrammatic view similar to FIG. 3 but illustrating the manner in which the direction of rotation of the air motor is reversed to permit cleaning of the opposite side of the air duct.
FIG. 5 is a side elevational view of the brush head.

Referring now to the drawings and more specifically to FIG. 1, it will be seen that one embodiment of the novel rotary air driven brush device, designated generally by the reference numeral 10, is thereshown. The air driven brush device 10 includes a reversible rotary pneumatic motor 11 of well known construction including an elongate cylindrical motor housing 12 having a rear end 13 and a front end 14. The rotary pneumatic motor 11 includes a chamber 15 having a turbine 16 revolvably mounted therein for rotatably driving an output shaft 17 projecting from the front end 14. Since the rotary pnuematic motor 11 is, for the most part, a conventional commercial type motor, the details of construction thereof are thought to be unnecessary for the present invention.

The brush device 10 includes an elongate cylindrical rotary brush head 18 including an elongate cylindrical mounting member 19 formed of a suitable rigid material, such as aluminum, and having a rear end **19*a* and a front end 20. The brush head mounting member 19 has a cylindrical exterior surface 21 and a threaded bore 22 extending completely therethrough. The output shaft 17 of the rotary pneumatic motor 11 threadedly engages the threaded bore 22 to secure! the brush head mounting member to the motor. The brush head mounting member 19 has a plurality of openings 23 that extend diametrically therethrough which are axially spaced apart. The brush head mounting member 19 also has a plurality of threaded openings 24 therein which are axially spaced apart, each of said openings 24 intersecting one of the openings 23** in the brush head.

Figure 6:
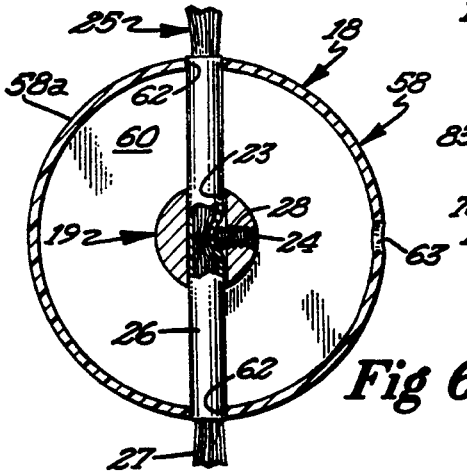
FIG. 6 is a cross-sectional view of the brush head taken approximately along line 6—6 of FIG. 5 and looking in the direction of the arrows.
Figure 8:
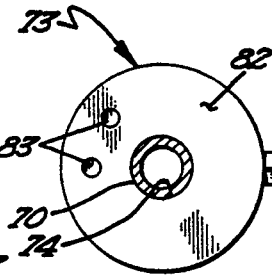
FIG. 8 is a cross-sectional view taken approximately along line 8—8 of FIG. 7 and looking in the direction of the arrows.
Figure 9:
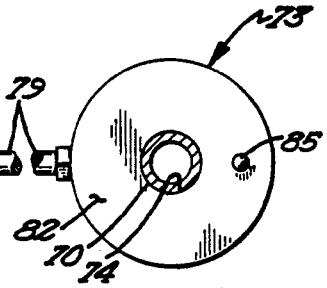
FIG. 9 is a cross-sectional view taken approximately along line 9—9 of FIG. 7 and looking in the direction of the arrows.

The brush head mounting member 19 also includes a plurality of elongate brush members 25 that are axially spaced apart and are angularly related with respect to each other. Each brush member 25 includes an elongate tubular bristle holder element 26 which projects through one of the openings 23 and which has a length so that opposite ends thereof project radially from the brush head 18. Each tubular element 26 is formed of plastic and elongate somewhat stiff bristles 27 are of a sufficient length to project longitudinally from the adjacent end of the tubular element 26. Suitable set screws 28 threadedly engage the threaded openings 24 and releasable lock each tubular element 26 in mounted relation within the mounting member 19 as best seen in FIG. 6. The set screws also clamp the bristles within the tubular elements 26.

The brush head 18 also includes an outer housing 58 comprising a pair of identical sections **58*a*. The outer housing 58 is formed of a rigid plastic material and each section 58*a* includes a cylindrical portion 59 and an end wall 60. The end walls 60** each has an opening therein.

The opening in the end walls 60 of the rear section 58*a* will be disposed in registering relation with the threaded bore 22 in the rear end wall 19*a* of the mounting member 19. The opening in, the end 60 of the front section 58*a* will be disposed in registering relation with the threaded bore 22 to permit the bolt 61 to clamp the housing 58 on the inner mounting member 19.

The cylindrical portions 59 of the sections 58*a* each have a plurality of diametrically opposed large openings 62 therein for accommodating the brush members 25 therethrough. It will be noted that the ends of the tubular elements 26 project into the openings 62 as best seen in FIG. 6. The cylindrical portions 59 of the sections 58*a* each have a plurality of smaller openings 63 there to permit a user to insert a screw driver for adjusting the screws 28 used to retain the bristles or brush strands within the tubular elements.

Referring now to FIG. 1, it will be seen that the motor housing 12 has an elongate non-rotatable male coupling member 29 integrally formed with the rear end 13 thereof and projecting axially and rearwardly therefrom. The non-rotatable coupling member 29 has a plurality of detent recesses 30 therein and is adapted to be connected to one end of an elongate flexible supply line 31. In this regard, it will be noted that the supply line 31 has a female coupling member 32 secured to the end thereon and the female coupling element 32 is adapted to engage the non-rotatable male coupling member 29.

The female couple member 32 is of conventional construction and is provided with a ball detents (not shown) which engage the detent recesses 30 for releasable locking the motor housing 12 through to supply line 31. The spring urged locking sleeve of the female coupling member 32 is adapted to be retracted and thereafter released in a conventional manner during the coupling and uncoupling the female coupling member to the male coupling member 29. It is pointed out that although the rotary pneumatic motor 12 is of conventional construction, the provision of a non-rotatable male coupling member 29 is a novel element with respect to brush devices for cleaning air ducts. It will also be noted that the rotary pnuematic motor 11 is provided with a reversing valve operator 33. By actuating the valve operator 33, a valve (not shown) is actuated so that the motor turbine and output shaft will be driven in either counterclockwise or clockwise direction.

It is pointed out that the supply line 31 is preferably of flexible construction and is connected to a source of air under pressure which may be remote from the brush device 10. It is also pointed that the control valve for communicating the supply of air to the rotary pnuematic motor 11 is located at the supply source in the embodiment of FIG. 1. The male coupling member 29 communicates with the chamber 15 to supply air under pressure to the turbine 16to revolve the latter in either a clockwise or counterclockwise direction. The actuated position of the valve operator 33 determines the direction of rotation of the output shaft 17.

The selection of the bristles 27 will be dependent upon the surface to be cleaned. In some instances, hard metallic bristles (carbonized steel) may be used to clean certain ducts while different kinds of bristles will be used to clean insulation-lined ducts. In providing replaceable brush members, the brush members 25 may be readily replaced and removed with a minimum of effort and in a minimum of time. By having a supply of brush members which vary in kind and size (bristles), the size and kind of bristles may be readily selected for the particular duct to be cleaned, although one size covers a wide range of duct sizes.

Figure 7:
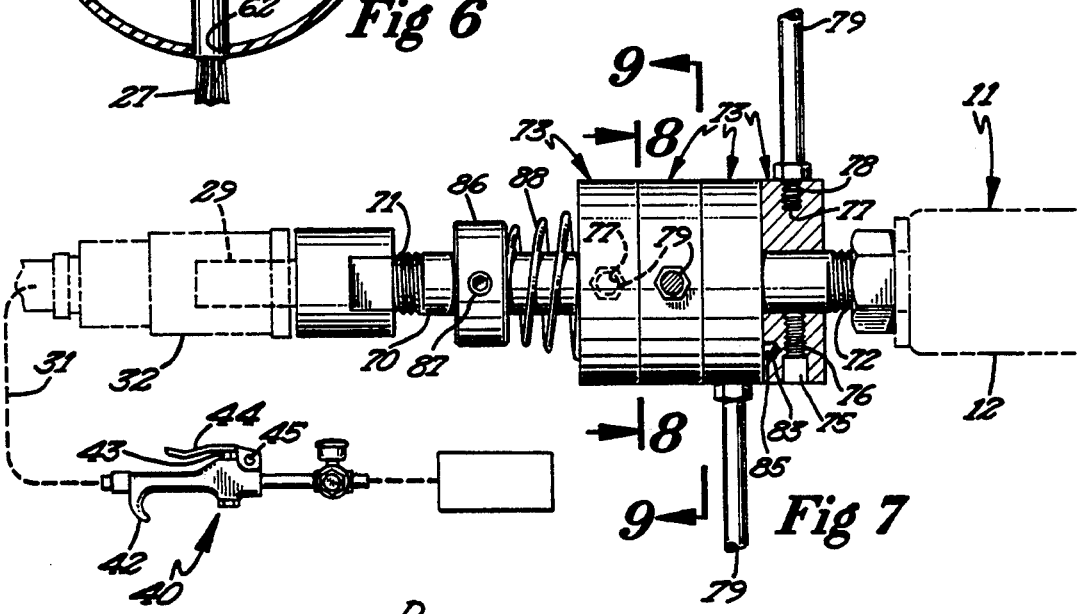
FIG. 7 is a modified form of the duct cleaning device.
Figure 10:
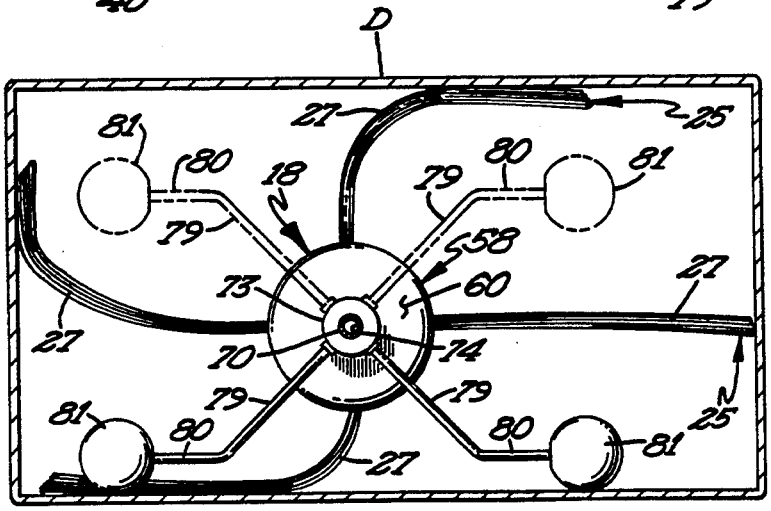
FIG. 10 is a diagrammatic cross-sectional view of a duct illustrating the brush head and guide and support members.

Referring now to FIG. 2, it will be seen that a slightly modified form of the invention is thereshown. The essential difference in the embodiment illustrated in FIG. 2 from that shown in FIG. 1 is the provision of a handle and actuating assembly 40 located closely adjacent rotary pneumatic motor 11. With this arrangement, the operator may open and close the air supply to the rotary pneumatic motor 11 by manipulating the controls. An auxiliary female coupling member 32*a* (female coupling member 32 in FIG. 7) is provided and connected in communicating relation with the non-rotatable male coupling member 29 in the manner of the embodiment of FIG. 1. The auxiliary female coupling member 32*a* is connected to an auxiliary supply line section 31*a* which is connected to the handle and actuating assembly 40. The handle and actuating assembly 40 is provided with a non-rotatable male coupling member 29 which is connected by a female coupling member 32 to an elongate flexible supply line 31 of the same construction as that illustrated if FIG. 1.

The handle and actuating assembly 40 is provided with a hand grip member 42 to facilitate gripping by a user and is also provided with a control valve button 43. The valve button 43 is normally urged to a closed position by resilient means (not shown) and is shifted to the open position by an elongate control valve actuator 44 which has one end thereof pivoted to the handle 40 by pivot 45.

Referring now to FIGS. 7 to 10, it will be seen that the novel duct cleaning brush device is provided with a novel support means which assures effective cleaning while minimizing damage to the duct being cleaned. An elongate pipe 70 is disposed between and connected in communicating relation with the female coupling member 32 and the rotary motor 11. The pipe 70 has its rear end 71 threaded and its forward end 72 threaded for threaded engagement respectively with the female coupling member 32 and the motor 11.

A plurality of similar leg mounting collars 73 each having an axial bore 74 are mounted on the pipe 70. It will be noted that the forward most collar 73 has a threaded radical bore 75 therein communicating with axial bore 74 for threadedly accommodating a set screw 76 therein. The set screw 76 locks the forward most collar 73 to the pipe 70.

Each collar 73 has a shallow threaded radial bore 77 therein for threadedly engaging the threaded end 78 of an elongate support leg 79. The legs 79 each have the outer end 80 thereof offset at approximately 45° from the remaining major portion of the leg. In the embodiment shown, approximately the outer one third of the leg is offset from the remaining portion. A ball or spherical type roller 81 is mounted on the outer end of the leg. The legs may be quickly and readily connected to and disconnected from the collars 73.

In the embodiment shown, there are four collars 73 and each collar may have a leg 79 attached thereto. The collars 73 may be angularly adjusted relative to each other to permit a corresponding adjustment of the position of the legs. In this regard, it will be noted that each collar 73 has opposed flat faces 82. In the preferred embodiment, one face 82 of a collar will have a pair of detent recesses 83 and the other face will have a detent 85. The detent recesses are spaced apart a distance corresponding to a 45° angle. Each detent will engage one of the recesses in the confronting face. With this arrangement, the collars 73 may be angularly adjusted relative to each other by an angle of 45°.

A lock collar 86 is mounted on the pipe 70 and is secured thereto by a set screw 87. A spring 88 is interposed between the lock collar 86 and the rearmost collar 73 to yieldably urge the collars against the forwardmost collar.

During operation of the embodiment of FIG. 2, the operator will actuate operation of the rotary pneumatic motor 11 by depressing the lever 44 thereby opening the supply of air to the motor housing 11 and to the turbine 16. The rotary brush head will be revolved in the selected direction by actuation of the reversing valve operator 33. If it becomes necessary to interrupt the supply of air to the rotary motor 11, the operator merely releases the lever 44 which closes air to the turbine and stops operation of the rotary brush head 18.

From the foregoing, it will be seen that I have provided a novel rotary air driven brush device 10 which is provided with a brush head that may be readily adjusted for cleaning air ducts of various sizes and construction. The use of replaceable brush members permits adjustment of the circumferential size of the rotary brush head in a minimum of time and in a minimum of effort.

Thus it will be seen that I have provided a rotary air driven brush device for cleaning air ducts which functions in a more efficient manner than any heretofore known comparable device.

What is claimed is:

1. A rotary air driven brush device for cleaning air ducts, comprising, a reversible rotary air motor having a front end and a rear end, and including a driven rotary output shaft projecting forwardly from the front end thereof, a brush head including an inner mounting member connected to said output shaft, a housing formed of plastic material surrounding said mounting member and being connected thereto, said housing including a cylindrical portion spaced radially outwardly of said mounting member, a plurality of elongate brush members mounted on said mounting member and projecting outwardly of said housing, support means including a plurality of legs non-rotatably mounted adjacent said brush head for engaging the interior surface of a duct to be cleaned to space the housing from the interior surface of a duct, an elongate flexible supply line having one end thereof connected to a source of air under pressure, means interconnecting the other end of said supply line to said air motor, and a control valve actuator controlling the supply of air under pressure to the air motor to permit rotation of the air brush head during cleaning of an air duct.

2. The brush device as defined in claim 1 wherein said mounting member and said housing each having a plurality of openings therein, each brush member including an elongate tubular element and a plurality of flexible brush elements projecting through said tubular element, said tubular elements being mounted in the openings in said mounting member and said brush elements projecting through said openings in the housing.

3. The brush device as defined in claim 1 and means mounting each of said legs for angular adjustment relative to each other.

4. The brush device as defined in claim 3 wherein each of said legs has a roller revolvably mounted thereon.

5. The brush device as defined in claim 3 wherein each of said legs is secured to said mounting means for quick and ready attachment and detachment thereto.

6. The brush device as defined in claim 3 wherein each of said legs is of elongate rigid construction, and each legs has an outer end portion angularly offset from the remaining portion of each leg.

7. The brush device as defined in claim 1 and an elongate conduit interconnecting the air motor with the flexible supply line, a plurality of annular leg mounting members mounted on said conduit and angularly adjustable relative thereto, each of said legs being secured to a respective one of said annular leg mounting members.

8. The brush device as defined in claim 7 and a plurality of rollers each mounted on a respective one of said legs and being revolvable relative thereto.

9. The brush device as defined in claim 8 wherein said rollers are of generally spherical configuration.

* * * * *